US005128065A

United States Patent [19]

Hollander

[11] Patent Number: 5,128,065

[45] Date of Patent: Jul. 7, 1992

[54] METHOD FOR THE INHIBITION OF CORROSION OF COPPER-BEARING METALLURGIES

[75] Inventor: Orin Hollander, Langhorne, Pa.

[73] Assignee: Betz Laboratories, Inc., Trevose, Pa.

[21] Appl. No.: 592,408

[22] Filed: Oct. 3, 1990

[51] Int. Cl.[5] ..... C23F 11/14

[52] U.S. Cl. ..... 252/394; 252/395; 422/16; 210/696

[58] Field of Search ..... 252/394, 395; 422/16; 210/696

[56] References Cited

U.S. PATENT DOCUMENTS

| | | | |
|---|---|---|---|
| 2,618,606 | 11/1952 | Schaffer | 252/137 |
| 4,101,441 | 7/1978 | Hwa et al. | 252/389 A |
| 4,246,030 | 1/1981 | Lipinski | 106/14.13 X |
| 4,277,359 | 7/1981 | Lipinski | 252/391 X |
| 4,387,027 | 6/1983 | May et al. | 210/697 |
| 4,406,811 | 9/1983 | Christensen et al. | 252/180 |
| 4,744,950 | 5/1988 | Hollander | 252/390 X |

FOREIGN PATENT DOCUMENTS 56-142873 11/1981 Japan .
57-152476 9/1982 Japan .

OTHER PUBLICATIONS

Weisstuch et al., Chelation Compounds as Cooling Water Corrosion Inhibitors, Materials Performance, Apr. 1971.

*Primary Examiner*—Deborah L. Kyle
*Assistant Examiner*—Valerie D. Fee
*Attorney, Agent, or Firm*—Alexander D. Ricci; Gregory M. Hill

[57] ABSTRACT

A method for inhibiting the corrosion of copper or copper-bearing metals in contact with an aggressive aqueous environment by combining a copper corrosion inhibitor with a chelant. Azoles are employed as the corrosion inhibitor. Characteristic chelants include ethylenediamine tetracetic acid nitrilotriacetic acid, citric acid, tartaric acid and dialkyldithiocarbamates.

6 Claims, No Drawings

METHOD FOR THE INHIBITION OF CORROSION OF COPPER-BEARING METALLURGIES

FIELD OF THE INVENTION

The invention relates to methods of inhibiting the corrosion of copper-bearing alloys in contact with aqueous media.

BACKGROUND OF THE INVENTION

In many industrial processes, undesirable excess heat is removed by the use of heat exchangers in which water is used as the heat exchange fluid. Copper and copper-bearing alloys are often used in the fabrication of such heat exchangers, as well as in other parts in contact with the cooling water, such as pump impellers, stator and valve parts. The cooling fluid is often corrosive towards these metal parts by virtue of containing aggressive ions and by the intentional introduction of oxidizing substances for biological control. The consequences of such corrosion are the loss of metal from the equipment, leading to failure or requiring expensive maintenance, creation of insoluble corrosion product films on the heat exchange surfaces, leading to decreased heat transfer and subsequent loss of productivity, and discharge of copper ions which can then "plate out" on less noble metal surfaces and cause severe galvanic corrosion, a particularly insidious form of corrosion.

Accordingly, it is common practice to introduce corrosion inhibitors into the cooling water. These materials interact with the metal to directly produce a film which is resistant to corrosion, or to indirectly promote formation of protective films by activating the metal surface so as to form stable oxides or other insoluble salts. However, such protective films are not completely stable, but rather are constantly degrading under the influence of aggressive conditions in the cooling water. Under very aggressive aqueous environments, such as those defined as brackish, those containing salt or brine or those containing sulfides, the maintenance of protective films is particularly difficult. The common copper corrosion inhibitors, such as benzotriazole, tolytriazole or mercaptobenzotriazole cannot establish a passive film on the metallic surface under these conditions. This is true even for the exceptional copper corrosion inhibitor, n-butyl benzotriazole. It appears that the copper ions produced at a high rate under these conditions complex with and deactivate the inhibitors. However, if excess inhibitor is used, the result is the undesirable formation of a film consisting of the insoluble copper-inhibitor complex. It is an object of this invention to provide an effective corrosion inhibitor for copper or copper containing surfaces in contact with a very aggressive aqueous environment.

DESCRIPTION OF THE RELATED ART

U.S. Pat. No. 2,618,606, Schaffer, discloses a composition useful in preventing the discoloration of metal surfaces, including copper, in contact with aggressive aqueous environments. The patentee teaches using azoles, such as benzotriazole, along with either select salts or phosphates.

The combination of azoles with phosphates is further taught in U.S. Pat. No. 4,101,411, Hwa et al. The patentees disclose a composition and method for controlling corrosion in aqueous systems comprising an azole, a water soluble phosphate and a water soluble organophosphonic acid. In addition, Japanese Patent 56-142872 describes similar technology. In this patent, benzotriazole is combined with organophosphoric acid to produce an effective metal corrosion inhibitor.

U.S. Pat. No. 4,406,811, Christensen et al., discloses a composition and method for inhibiting corrosion in aqueous systems using triazoles in combination with carboxylic acids.

A 1971 publication authored by Weisstuch et al., teaches that chelating agents, such as ethylenediaminetetraacetic acid, are useful as metal corrosion inhibitors in aqueous systems. These compounds achieve this result by being "chemisorbed" on the metal surface to form a metal-chelant complex layer. Similarly, Japanese Patent 57-152476 discloses the formation of a metal ligand layer comprising use of a composition consisting of benzotriazole and N-cyclic amines.

GENERAL DESCRIPTION OF THE INVENTION

The corrosion inhibitor of the present invention is intended to function in aggressive aqueous systems in contact with copper bearing metallurgies. Systems which are high corrosive to copper include brackish or salt water. Additionally, sulfides or what are commonly referred to as brines may be present.

Conventional copper corrosion inhibitors, such as azole compounds, are combined with certain chelants to form an inhibitor especially effective in the aggressively corrosive environments defined above. What is surprising is that these chelants, when used alone, are corrosive to copper metallurgy. Furthermore, the azoles alone are very ineffective under aggressive aqueous conditions. It is believed that these inhibitors are prevented from forming their usual passive film on the metallic surface because the copper ions which are produced at such a high rate under these aggressive circumstances complex with and deactivate the inhibitors. If excess inhibitor is used as undesireable insoluble copper/inhibitor complex forms which may lead to underdeposit corrosion.

DETAILED DESCRIPTION OF THE INVENTION

It has been discovered that in accordance with the method of the present invention a chelant which forms a stable, water soluble complex with copper, used in conjunction with a copper corrosion inhibitor will promote the formation of passive film to inhibit corrosion in aggressive aqueous systems.

This invention comprises combining azoles with certain select chelants. The azoles utilized according to the present invention generally include benzotriazole, benzimidazole, and mercaptobenzothiazole. The benzotriazole compound also encompasses its $C_1$ to $C_6$ alkyl derivatives, hydroxybenzotriazole and its $C_1$ to $C_6$ alkyl derivatives and carboxybenzotriazole and its $C_1$ to $C_6$ alkyl derivatives. These compounds have the formula:

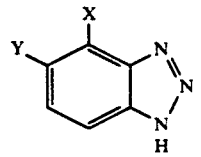

where X is H, OH, $CO_2H$, or $CnH_{2n}+1$, n=1 to 6, and Y is H, OH, $CO_2H$, and Y≠X unless Y=H.

The benzimidazole compound also encompasses its $C_1$ to $C_6$ alkyl derivatives, hydroxybenzimidazole and its $C_1$ to $C_6$ alkyl derivatives and caroboxybenzimidazole and its $C_1$ to $C_6$ alkyl derivatives. These compounds have the formula:

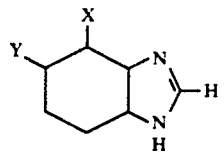

where X is H, OH, $CO_2H$ or $CnH_{2n}+1$, n=1 to 6, and Y is H, OH, $CO_2H$, and Y≠X unless Y=H.

the mercaptobenzothiazole compound also encompasses its $C_1$ to $C_6$ alkyl derivatives, hydroxymercaptobenzothiazole and its $C_1$ to $C_6$ alkyl derivatives, and carboxymercaptobenzothiazole and its $C_1$ to $C_6$ alkyl derivatives. These compounds have the formula;

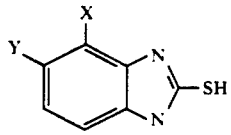

where X is H, OH, $CO_2H$, or $CnH_{2n}+1$, n=1 to 6, and Y is H, OH, $CO_2H$, and Y≠X unless Y=H.

The chelants according to the present invention include ethylenediaminetetraacetic acid (EDTA), the mono-or triesters of EDTA, nitrilotriacetic acid or monoesters thereof, ethylenediamine mono or tricarboxylic acid, citric acid, its salts and derivatives thereof, tartaric acid, its salts and derivatives thereof, and dialkyldithiocarbomates.

The corrosion inhibitor may be added to the aqueous system to be treated as a preblended composition by combining the azole and chelant components beforehand, or each component may be added separately. The concentration of the two components may vary in response to different aqueous environments. Generally, however the azole compound may be added in an amount to maintain a concentration of from about 0.1 ppm to about 1000 ppm and the chelant may also be added in an amount to maintain a concentration of from about 0.1 ppm to about 1000 ppm, in excess of any competing demand by hardness ions present in the environment.

Beaker Tests

The following test results show the synergistic corrosion inhibition properties exhibited by combining an azole with a chelant. The tests were conducted at room temperature in 2 liter beakers. Water composition was as follows: (per liter) 25.22 g NaCl (15,300 ppm Cl), 16.82 g $Na_2SO_4$, 0.166 g $NaHCO_3$ and having a pH adusted to 8.15 with NaOH and $H_2SO_4$. No hardness ion was included so as not to interfere with the demand for chelant by the copper ion. Cupronickel (90/10) coupons were cleaned and weighed prior to immersion. The coupons were then exposed for 24 hours to one of the 9 test solutions identified below. They were then cleaned and reweighed. The results are as follows:

| Test No. | butyl-benzo-triazole (ppm) | tetra-sodium ethylenediamine tetraacetic acid (ppm) | Corrosion Rate (MPY) | Copper Concentration (PPM) |
|---|---|---|---|---|
| 1 | 5 | 0 | 13.1 | 0.37 |
| 2 | 5 | 1 | 12.8 | 0.52 |
| 3 | 5 | 5 | 16.3 | 0.61 |
| 4 | 50 | 5 | 4.2 | <0.05 |
| 5 | 50 | 25 | 3.1 | <0.05 |
| 6 | 0 | 100 | 21.6 | 11.8 |
| 7 | 0 | 0 | 16.3 | 0.13 |
| 8 | 100 | 0 | 1.1 | <0.5* |
| 9 | 100 | 100 | 1.0 | <0.5** |

*coupon had green tarnish on surface
**coupon was clean and shiny

Tests 1-3 show that low concentrations of butyl-benzotriazole with or without the chelant do not inhibit corrosion of the copper alloy. Tests 6 and 7 indicate that the chelant alone is more aggressive than no chelant at all. Tests 8 and 9 show that even though very high levels of inhibitor can passivate the metal without chelant, an undesirable green tarnish develops in the absence of the chelant.

Recirculator Tests

In the tests, a hardness ion was included so as to stimulate sea water conditions. Accordingly, the $Na_4$ EDTA concentration was adjusted to take into account demand by the hardness ion. On this basis, 3.74 ppm of $Na_4$ EDTA was used for every 1.0 ppm of hardness ion, expressed as $CaCO_3$ equivalent.

Water conditions were as follows: (per liter) 11.831 g $MgSO_4.7H_2O$ (4800 ppm as $CaCO_3$), 1.544 g $CaCl_2.2H_2O$ (1050 ppm as $CaCO_3$), 23.997 g NaCl (15,300 ppm total Cl), 16.2 g $Na_2SO_4$ and 0.166 g $NaHCO_3$ at 123° F. Total hardness was measured to be 5200 ppm as $CaCO_3$.

To the water was added 19,800 ppm of $Na_4$ EDTA ($3.74\times5200+100$) and 100 ppm of butyl-benzotriazole. The large concentration of $Na_4$EDTA was required because the specific hardness ion used herein would complex with the chelant and thereby prevent it from interacting with the metal ion. Other hardness ions may not place such a demand, if any, on the chelant, therefore not requiring the loading of so much of the chelant into the system. Under conditions where there is no competing demand, the chelant concentration need not exceed 1,000 ppm. Six samples of cupronickel (90/10) coupons preweighed, immersed and weighed again as shown above. The coupons exhibited corrosion rates of between 0.02 and 0.07 mpy with no tarnishing of the metallurgy being evident.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A method for inhibiting the corrosion of copper or copper-bearing metals in contact with an aggressive aqueous environment comprising brackish water, salt water, or water containing brine or sulfides by forming a passive film on the surface of said metals comprising generating a water soluble copper complex consisting essentially of adding to said aggressive aqueous environment a sufficient amount for the purpose of a copper corrosion inhibitor and a chelant selected from the group consisting of ethylenediamine tetraacetic acid, the mono- or triesters of ethylenediamine tetraacetic acid, ethylenediamine mono or tricarboxylic acid, nitrilo triacetic acid or monoester thereof, citric acid, its salts and derivatives thereof, tartaric acid, its salts and derivatives thereof and dialkyldithiocarbamates.

2. A method according to claim 1 wherein said copper corrosion inhibitor is selected from the group consisting of benzotriazole and its $C_1$ to $C_6$ alkyl derivatives, hydroxy benzotriazole and its $C_1$ to $C_6$ alkyl derivatives, and carboxybenzotriazole and its $C_1$ to $C_6$ alkyl derivatives having the formula:

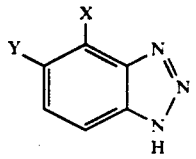

where X is H, OH, $CO_2H$ or$C_nH_{2n+1}$, n=1 to 6, and Y is H, OH, $CO_2H$, and Y≠X unless Y=H.

3. A method according to claim 1 wherein said copper corrosion inhibitor is selected from the group consisting of benzimidazole and its $C_1$ to $C_6$ alkyl derivatives, hydroxy benzimidazole and its $C_1$ to $C_6$ alkyl derivatives, and carboxybenzimidazole and its $C_1$ to $C_6$ alkyl derivatives, having the formula:

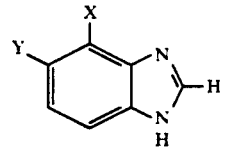

where X is H, OH, $CO_2H$, or $C_nH_{2n+1}$, n=1 to 6, and Y is H, OH, $CO_2H$, and Y≠X unless Y=H.

4. A method according to claim 1 wherein said copper corrosion inhibitor is selected from the group consisting of mercaptobenzothiazole and its its $C_1$ to $C_6$ alkyl derivatives, hydroxy mercaptobenzothiazole and its $C_1$ to $C_6$ alkyl derivatives, and carboxymercaptobenzothiazole and its $C_1$ to $C_6$ alkyl derivatives, having the formula:

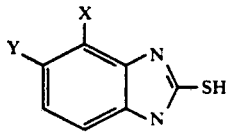

where X is H, OH, $CO_2H$, or $C_nH_{2n+1}$, n=1 to 6, and Y is H, OH, $CO_2H$, and Y≠X unless Y=H.

5. A method according to claim 1 comprising maintaining in said aggressive aqueous environment from about 0.1 to 1,000 ppm of said copper corrosion inhibitor.

6. A method according to claim 1 comprising maintaining in said aggressive aqueous environment from about 0.1 to 1,000 ppm of said chelant, in excess of competing demand by hardness ions.

* * * * *